US009706882B2

(12) United States Patent
Zhou et al.

(10) Patent No.: US 9,706,882 B2
(45) Date of Patent: Jul. 18, 2017

(54) SPLICING SHOWER

(75) Inventors: Huasong Zhou, Xiamen (CN); Yaohui Lin, Xiamen (CN); Zhicong Lin, Xiamen (CN); Zuqiang Zhuang, Xiamen (CN)

(73) Assignees: XIAMEN SOLEX HIGH-TECH INDUSTRIES CO., LTD., Xiamen (CN); Huasong Zhou, Xiamen (CN)

( * ) Notice: Subject to any disclaimer, the term of this patent is extended or adjusted under 35 U.S.C. 154(b) by 973 days.

(21) Appl. No.: 13/977,669

(22) PCT Filed: Dec. 29, 2011

(86) PCT No.: PCT/CN2011/084886
§ 371 (c)(1),
(2), (4) Date: Jun. 28, 2013

(87) PCT Pub. No.: WO2012/089136
PCT Pub. Date: Jul. 5, 2012

(65) Prior Publication Data

US 2013/0291298 A1 Nov. 7, 2013

(30) Foreign Application Priority Data

Dec. 30, 2010 (CN) ..... 2010 1 0618458

(51) Int. Cl.
*A47K 3/022* (2006.01)
*A47K 3/28* (2006.01)
(Continued)

(52) U.S. Cl.
CPC ..... *A47K 3/28* (2013.01); *B05B 1/1609* (2013.01); *B05B 1/169* (2013.01); *B05B 1/18* (2013.01); *B05B 1/3013* (2013.01); *B05B 15/065* (2013.01)

(58) Field of Classification Search
USPC ..... 4/601, 615
See application file for complete search history.

(56) References Cited

U.S. PATENT DOCUMENTS 3,563,462 A 2/1971 Bauer
5,353,448 A * 10/1994 Lee ..... E03C 1/06 4/567

(Continued)

FOREIGN PATENT DOCUMENTS

CN 201482611 U 5/2010
CN 102059178 A 5/2011

(Continued)

*Primary Examiner* — Lauren Crane
(74) *Attorney, Agent, or Firm* — Rabin & Berdo, P.C.

(57) ABSTRACT

A splicing shower has a main shower, which is disposed with an inlet waterway, a main outlet assembly and at least a water diversion connection, the main outlet assembly is connected to the inlet waterway, the water diversion connection is connected to the inlet waterway, the water diversion connection is disposed with an on-off switch. The assistant shower is disposed with a diversion waterway and an assistant outlet assembly, the assistant outlet assembly is connected to the diversion waterway. When the assistant shower is spliced to the main shower, the water diversion connection is connected to the diversion waterway, when the assistant shower is separated from the main shower, the switch is turned off.

19 Claims, 10 Drawing Sheets

(51) Int. Cl.

| | |
|---|---|
| ***B05B 1/16*** | (2006.01) |
| ***B05B 1/18*** | (2006.01) |
| ***B05B 1/30*** | (2006.01) |
| ***B05B 15/06*** | (2006.01) |

(56) References Cited

U.S. PATENT DOCUMENTS

| | | | | |
|---|---|---|---|---|
| 6,286,158 | B1 * | 9/2001 | Lin | B05B 1/185 239/447 |
| 6,775,865 | B1 * | 8/2004 | Lin | B05B 1/18 4/596 |
| 8,191,185 | B2 * | 6/2012 | Tsai | E03C 1/0408 239/444 |
| 2005/0214147 | A1 | 9/2005 | Schultz et al. | |

FOREIGN PATENT DOCUMENTS

| | | | |
|---|---|---|---|
| EP | 1472966 | A2 | 11/2004 |
| GB | 1307712 | A | 2/1973 |

* cited by examiner

SPLICING SHOWER

FIELD OF THE INVENTION

The present invention relates to a splicing shower, especially to a splicing shower which can change the outlet area.

BACKGROUND OF THE INVENTION

The outlet area of the existing shower can not be changed, which can not satisfy the requirements of the user. There is a combined shower in the market, for example in the Chinese patent database with patent number ZL200620156306.7 and ZL200580036723.6. it is disposed with a water pipe, a three-way valve, a fixed shower and a hand shower. The water pipe is connected to the inlet of the three-way valve, the fixed shower and the hand shower are separately connected to the two outlets of the three-way valve. The fixed shower is disposed with a fixation holder, the hand shower is detachable to the fixation holder of the fixed shower. Users can select the fixed shower outlet to outlet, the hand shower to outlet or the two to outlet at the same time to change the outlet area. It has disadvantages as below: the fixed shower and the hand shower are controlled by the three-way valve off the shower to outlet, the fixed shower is connected to the three-way valve by rigid water pipe, and the hand shower is connected to the three-way valve by flexible pipe, the cost is high.

SUMMARY OF THE INVENTION

The present invention is provided with a splicing shower, which overcomes the disadvantages of the shower of the existing technology.

The technical proposal of the present invention to solve the technical problem is as below:

A splicing shower, wherein comprising:

A main shower (100), which is disposed with an inlet waterway (110), a main outlet assembly (120) and at least a water diversion connection (130), the main outlet assembly (120) is connected to the inlet waterway (110), the water diversion connection (130) is connected to the inlet waterway (110), the water diversion connection (130) is disposed with an on-off switch (131); and At least an assistant shower (200), which is disposed with a diversion waterway (210) and an assistant outlet assembly (220), the assistant outlet assembly (220) is connected to the diversion waterway (210);

Thereinto, the assistant shower (200) can be spliced to the main shower (100) to form an assembly and disassembly connection, when the assistant shower (200) is spliced to the main shower (100), the water diversion connection (130) is connected to the diversion waterway (210), when the assistant shower (200) is separated from the main shower (100), the switch (131) is turned off.

In another preferred embodiment, the switch (131) is a check valve, which is disposed with a valve spool (1311) and a withstand spring (1312), the valve spool (1311) is assembly inside the water diversion connection (130) in sliding way, the withstand spring (1312) is assembled inside the water diversion connection (130) and withstood the valve spool (1311) to make the valve spool (1311) normal off.

In another preferred embodiment, the assistant shower (200) is further disposed with a touch mechanism (230), which includes a control member (231) and a push bar (232), the control member (231) is controlled by user to drive the push bar (232) to move, making the switch (131) switched on/off.

In another preferred embodiment, the main shower (100) is disposed with an on-off mechanism (140), which is controlled by user to control the on-off of the main outlet assembly (120) and the inlet waterway (110).

In another preferred embodiment, the control member (231) is rotated and assembled in the assistant shower (200), the push bar (232) is assembled in the assistant shower (200) in sliding way, the push bar (232) is extended out of the assistant shower (200) to withstand the valve spool (1311).

In another preferred embodiment, the touch mechanism (230) further includes a turnplate (233), which is rotated and assembled inside the assistant shower (200), the turnplate (233) is synchronously rotated with the control member (231) coaxially, the shaft end face of the turnplate (233) is disposed with a linkage groove, the push bar (232) is disposed with a linkage pin (2321) in the lower; the linkage pin (2321) is connected to the linkage groove, making the turnplate (233) driving the push bar (232) to slide when the turnplate (233) rotates.

In another preferred embodiment, the assistant shower (200) is further disposed with a touch mechanism (230), which includes a push bar (232) connected to the assistant shower (200) in sliding way, when the assistant shower (200) is assembled to the main shower (100), the touch mechanism (230) makes the push bar (232) sliding out to turn on the on-off switch (131), when the assistant shower (200) is disassembled from the main shower (100), the touch mechanism (230) makes the push bar (232) sliding back to turn off the on-off switch (131).

In another preferred embodiment, the touch mechanism (230) further includes a press bar (234), a linkage bar (235) and a restore spring (236); the press bar (234) is assembled inside the assistant shower (200) in sliding way; the restore spring (236) withstands the press bar (234) and the assistant shower (200); the centre of the linkage bar (235) is pivot joint to the assistant shower (200), two ends of the linkage bar (235) are separately connected to the press bar (234) and the push bar (232), making that: when the assistant shower (200) is assembled to the main shower (100), the press bar (234) is sliding back, the linkage bar (235) is rotated, the push bar (232) is sliding out, the restore spring (236) is compressed to restore energy; when the assistant shower (200) is disassembled from the main shower (100), the restore spring (236) releases energy, making the press bar (234) sliding out, the linkage bar (235) rotated and the push bar (232) sliding back.

In another preferred embodiment, the water diversion connection (130) is assembled in the main shower (100) in sidling way, a restore spring (150) is disposed between the water diversion connection (130) and the main shower (100); the external wall of the outside end of the water diversion connection (130) is a first conical surface (132) of big inside small outside; the inner wall of the outside end of the diversion waterway is a second conical surface (211) of big outside small inside, the second conical surface (211) is coupled to the first conical surface (132);

The part of the outside end face of the assistant shower (200) below the outside end of the diversion waterway (210) is a guide inclined surface (240);

The end of the press bar (234) is extended out of the guide inclined surface (240).

In another preferred embodiment, the side end face of the main shower (100) is disposed with a lock groove (160), the water diversion connection (130) is corresponding to the lock groove (160); the end face of the assistant shower (200) is disposed with a lock holder (250), the outside end of the diversion waterway (210) is corresponding to the lock holder (250); the lock holder (250) can be spliced to the lock groove (160) to form an assembly and disassembly connection.

In another preferred embodiment, the main shower (100) is a regular hexagon shaped with six end faces, each end face is disposed with a lock groove (160), the water diversion connection (130) is corresponding to the lock groove (160); the number of the assistant shower (200) is six, one end face of each assistant shower (200) is disposed with a lock holder (250), the outside end of the diversion waterway (210) is corresponding to the lock holder (250); the lock holder (250) can be spliced to the lock groove (160) to form an assembly and disassembly connection.

Compared to the existing technology, the technical proposal of the present invention has advantages as below:

1. When the main shower is separated from the assistant shower, the on-off switch is turned off, when the main shower is spliced with the assistant shower, the water diversion connection is connected to the diversion waterway, the on-off switch is controlled to turn on, user can change the outlet area by splicing the main shower and the assistant shower as required;
2. The assistant shower can be directly connected to the inlet waterway of the main shower by diversion waterway and water diversion connection, the structure is simple and the cost is low; use can select different assistant showers (such as different assistant showers with different outlet type) to splice to the main shower as required;
3. The touch mechanism of the assistant shower is disposed to realize switch of the on-off switch, even in splicing state, user can control the assistant shower to outlet;
4. The main shower is disposed with an on-off mechanism to control the connection of the main outlet assembly and the inlet waterway, user can control the main shower to outlet;
5. The on-off switch is a check valve with well sealing performance, which is convenient to realize switching by cooperated to the touch mechanism;
6. The check valve is controlled to turn on/off by the cooperation of the control member, the turnplate and the push bar, the structure is simple and the control is reliable;
7. The check valve is controlled to turn on/off automatically by the cooperation of the press bar, the linkage bar and the push bar, the structure is simple and the control is reliable;
8. A restore spring is disposed between the water diversion connection and the main shower, the external wall of the outside end of the water diversion connection is a first conical surface; the inner wall of the outside end of the diversion waterway is a second conical surface, the outside end face of the assistant shower is a guide inclined surface, making it easy to assemble and disassemble the main shower and the assistant shower, it makes sure of the sealing performance of the water diversion connection and the diversion waterway;
9. The main shower is disposed with several water diversion connections of annular arranged, the number of the assistant shower is equal to that of the water diversion connection, the present invention has a beautiful appearance.

BRIEF DESCRIPTION OF THE DRAWINGS

The present invention will be further described with the drawings and the embodiments.

DETAILED DESCRIPTION OF THE EMBODIMENTS

Figure 1:
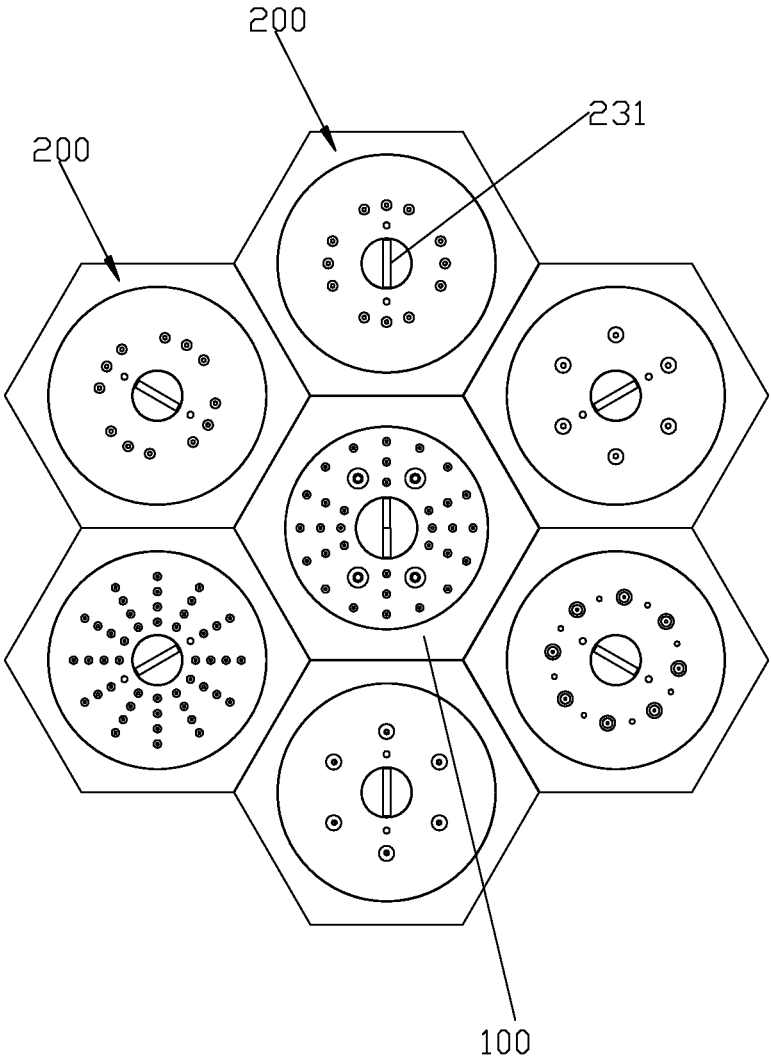
FIG. 1 illustrates the bottom view of the splicing shower of the first preferred embodiment of the present invention.
Figure 2:
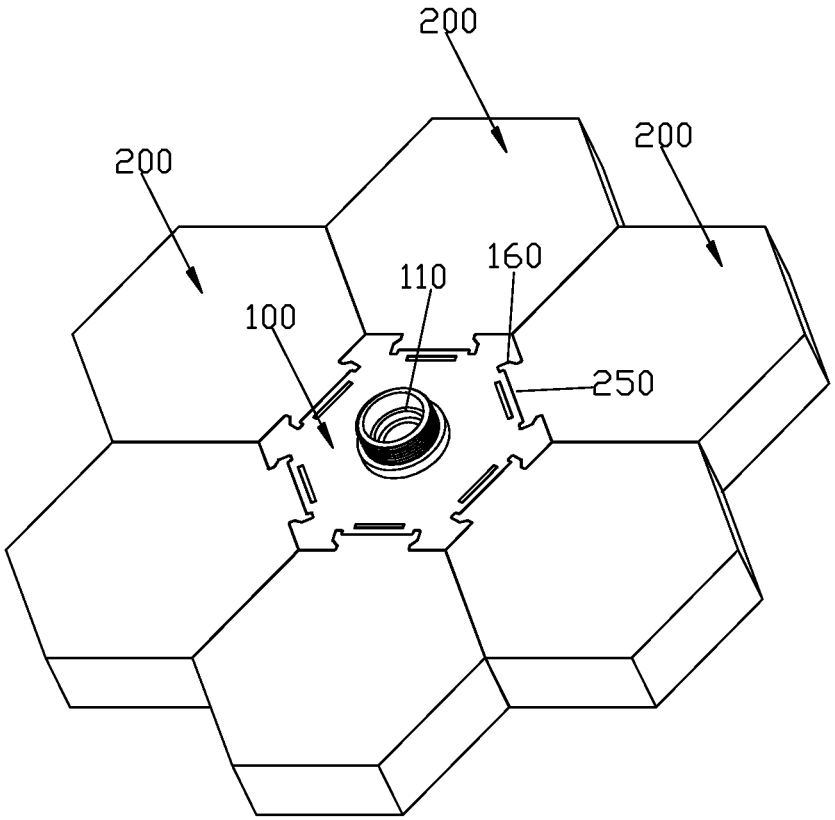
FIG. 2 illustrates the structure of the splicing shower of the first preferred embodiment of the present invention.
Figure 3:
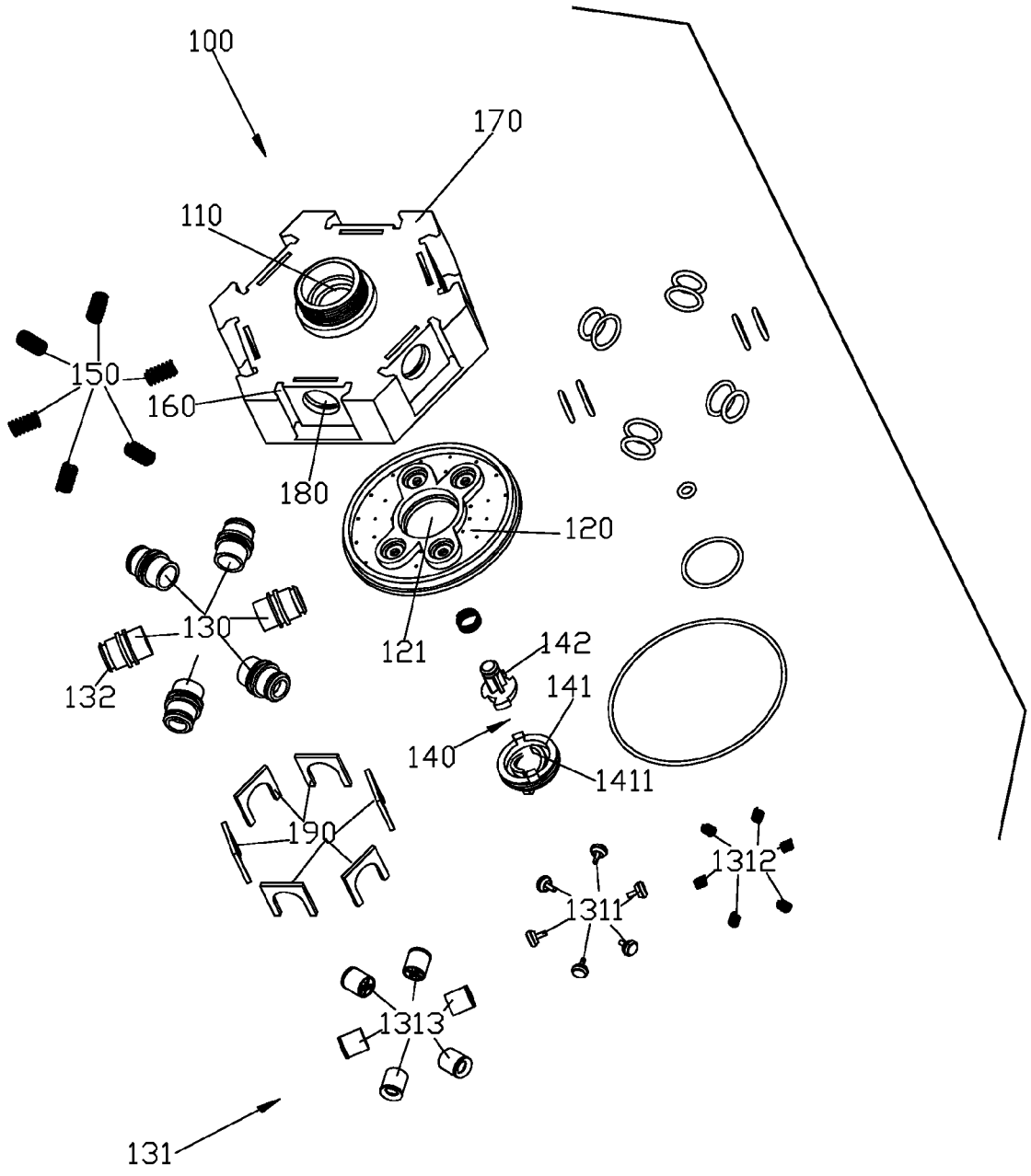
FIG. 3 illustrates the breakdown structure of the main shower of the first preferred embodiment of the present invention.
Figure 4:
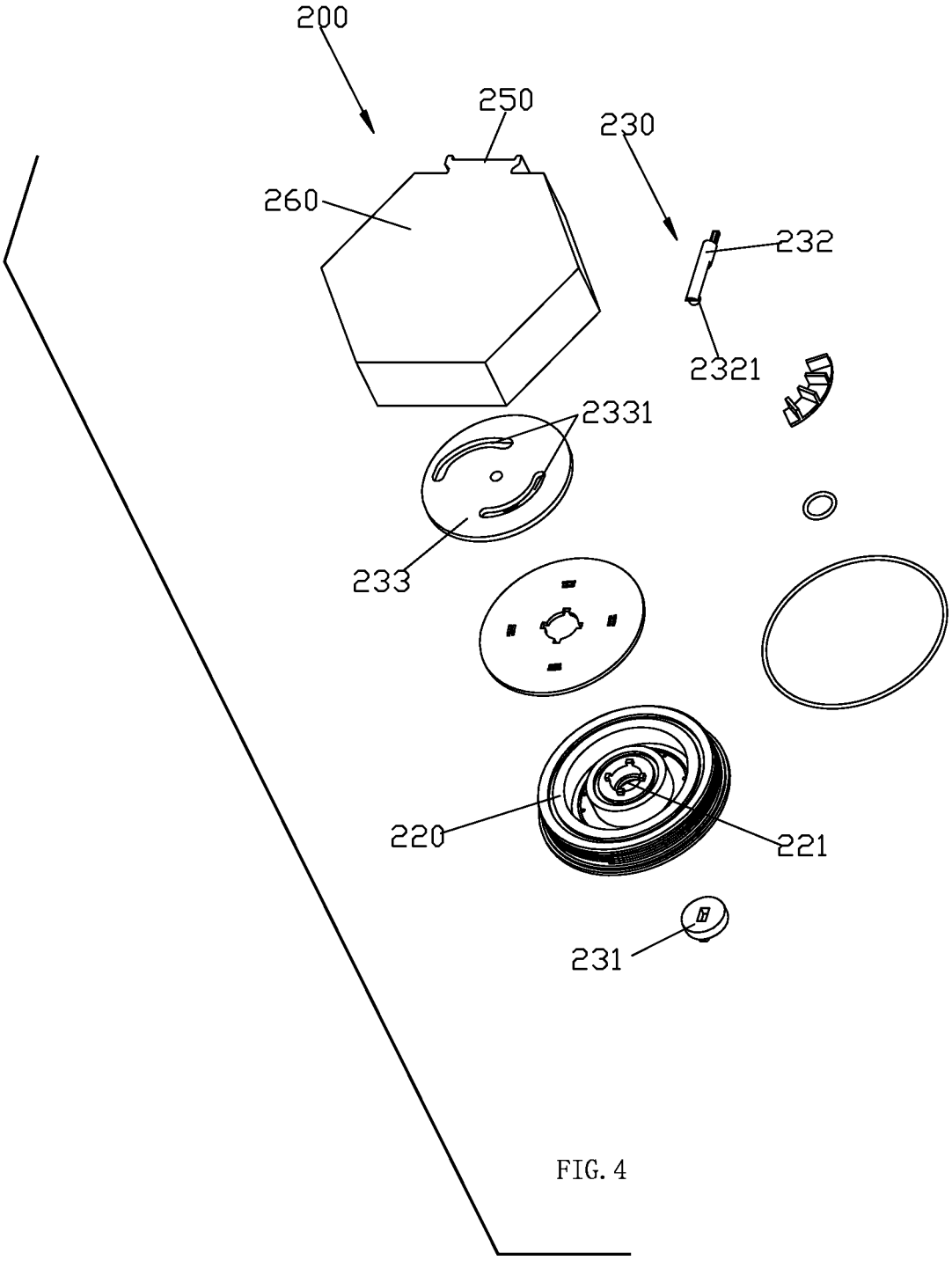
FIG. 4 illustrates the breakdown structure of the assistant shower of the first preferred embodiment of the present invention.
Figure 5:
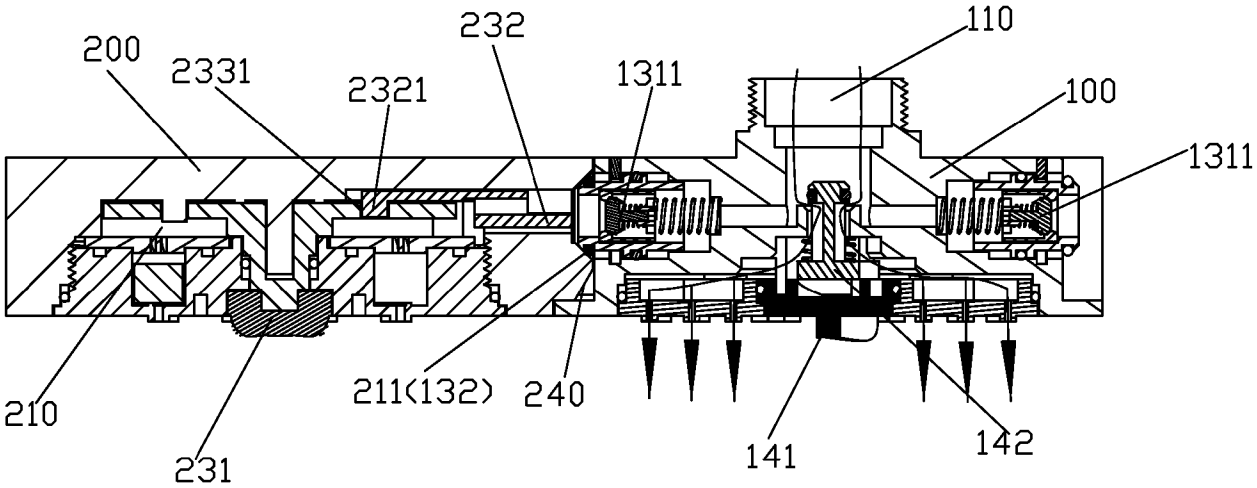
FIG. 5 illustrates the sectional view of the splicing shower of the first preferred embodiment of the present invention when the main shower is spliced with an assistant shower and water flows out of the main shower.
Figure 6:
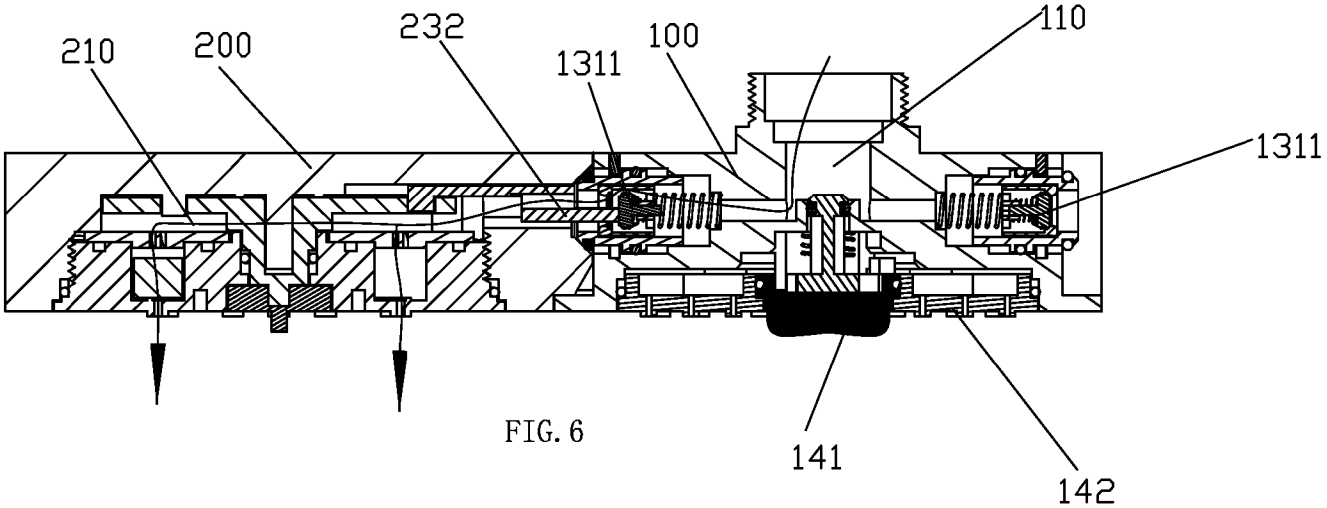
FIG. 6 illustrates the sectional view of the splicing shower of the first preferred embodiment of the present invention when the main shower is spliced with an assistant shower and water flows out of the assistant shower.
Figure 7:
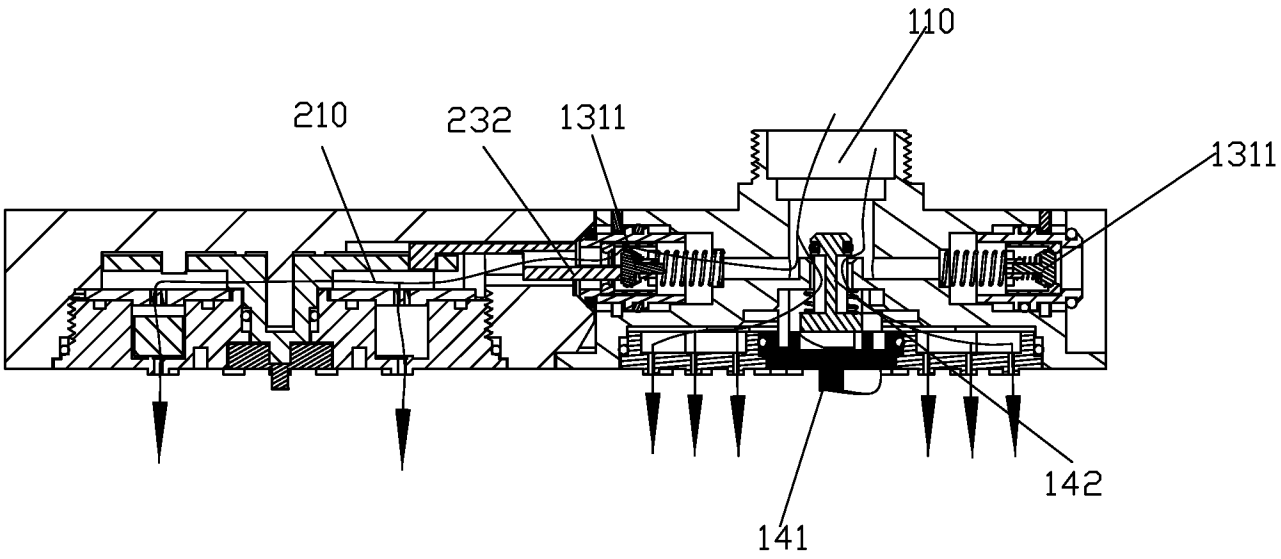
FIG. 7 illustrates the sectional view of the splicing shower of the first preferred embodiment of the present invention when the main shower is spliced with an assistant shower and water flows out of the main shower and the assistant shower.

The first embodiment, please refer to FIG. 1 to FIG. 7; a splicing shower of the present invention includes a main shower 100 and six assistant showers 200.

The main shower 100 includes a first body 170, a main outlet assembly 120 and six water diversion connections 130. the first body 170 is regular hexagon shaped with six end faces, each end face is disposed with a lock groove 160.

The first body 170 is disposed with an inlet waterway 110 and six assistant waterways 180 of annular arranged, the inlet waterway 110 is divided into an upper section, a central section and a lower section, the assistant waterway 180 has an outside end and an inside end. The upper section of the inlet waterway 110 is connected to the water resource. The lower end of the inlet waterway 110 is big end down. Besides, the step groove end of the assistant waterway 180 is situated in the centre of the lock groove 160, that is to say, the water diversion connection 130 is corresponding to the lock groove 160.

The main outlet assembly 120 is assembled in the lower of the first body 170 and connected to the inlet waterway 110 to outlet. An on-off mechanism 140 is disposed between the main outlet assembly 120 and the inlet waterway 110 and controlled by user of the on-off of the lower section of the inlet waterway 110, that is to say, the on-off mechanism 140 is used to control the on-off of the inlet waterway 110 and the main outlet assembly 120. in this embodiment, the main outlet assembly 120 is annular shaped, the on-off mechanism 140 includes a knob 141 and a piston rod 142, the knob is rotated and connected inside the inner hole 121 of the main outlet assembly 120 in sealing way, the knob 141 is fixed with a screw rack 1411, the piston rod 142 can slide relatively to the lower section of the inlet waterway 110, the sliding up and down of the piston rod 142 controls the on-off of the lower section of the inlet waterway 110, for example, the piston rod 142 is fixed with a sealing, when the sealing is situated in the small hole of the lower section of the inlet waterway 110, the lower section of the inlet waterway 110 is turned off, when the sealing is situated in the big hole of the lower section of the inlet waterway 110, the lower section of the inlet waterway is turned on, that is to say, when the piston rod 142 is situated in the lower, the lower section of the inlet waterway 110 is turned off, when the piston rod 142 is situated in the upper, the lower section of the inlet waterway 110 is turned on.

Six water diversion connections 130 are separately sliding inside the step groove of the six assistant waterways 180 in sealing way. A restore spring 150 is disposed between the water diversion connection 130 and the step surface of the step groove of the assistant waterway 180, a board 190 is disposed in the end of the step groove to prevent the water diversion connection 130 from separating from the main shower 100, the outside end of the water diversion connection 130 is extended out of the board 190. the water diversion connection 130 is disposed with an on-off switch 131, which is a check valve in this embodiment. The check valve includes a valve body 1313, a valve spool 1311 and a withstand spring 1312, the valve body 1313 is fixed inside the water diversion connection 130 in a sealing way, the valve spool 1311 is assembled inside the valve body 1313 of the water diversion connection 130 in sliding way, the withstand spring 1312 is assembled inside the water diversion connection 130 to make the valve spool 1311 in normal off.

The assistant shower 200 includes a second body 260 and an assistant outlet assembly 220, the second body 260 is regular hexagon shaped with six end faces. One end face of the assistant shower 200 is disposed with a lock holder 250, which is spliced to the lock groove 160 to form an assembly and disassembly connection, that is to say, the main shower 100 can be spliced with the assistant shower 200 to form an assembly and disassembly connection.

The assistant outlet assembly 220 is assembled to the second body 260, the assistant outlet assembly 220 is annular arranged. The second body 260 is disposed with a diversion waterway 210 inside, the outside end of the diversion waterway 210 is situated in the centre of the lock holder 250, the inside end is connected to the assistant outlet assembly 220 to outlet.

The assistant shower 200 is further disposed with a touch mechanism 230, which includes a control member 231, a push bar 232 and a turnplate 233. the control member is rotated and assembled inside the inner hole 221 of the assistant outlet assembly 220 of the assistant shower 200 in sealing way. The turnplate 233 is rotated and assembled inside the second body 260 of the assistant shower 200, the turnplate 233 is synchronously rotated with the control member 231 coaxially, the shaft end face of the turnplate 233 is disposed with a linkage groove 2341. The push bar 232 is assembly inside the second body 260 of the assistant shower 200 in sliding way, the push bar 232 is disposed with a linkage pin 2321 in the lower; the linkage pin 2321 is connected to the linkage groove, making the turnplate 233 driving the push bar 232 to slide when the turnplate 233 rotates. The push bar 232 can be extended out of the outside end of the diversion waterway 210 of the assistant shower 200 and the push bar 232 can withstand the valve spool 1311.

In this embodiment, to make sure the convenience of the assembly and disassembly of the water diversion connection and the diversion waterway 210, it can be designed that: the external wall of the outside end of the water diversion connection 130 is a first conical surface 132 of big inside small outside; the inner wall of the outside end of the diversion waterway is a second conical surface 211 of big outside small inside, the second conical surface 211 is coupled to the first conical surface 132; the part of the outside end face of the assistant shower 200 below the outside end of the diversion waterway 210 is a guide inclined surface 240.

Thereinto: when the lock holder 250 of the assistant shower 200 is spliced to the lock groove 160 of the main shower 100, the water diversion connection 130 is connected to the diversion waterway 210, when user rotates the control member 231 to drive the push bar 232 to slide forwards and backwards to control the valve spool 1311 to slide and the check valve to turn on/off; when the main shower 100 is separated from the assistant shower 200, under the work of the withstand spring 1312, the valve spool is turned off, the on-off switch 131 is situated in sealing state.

Figure 8:
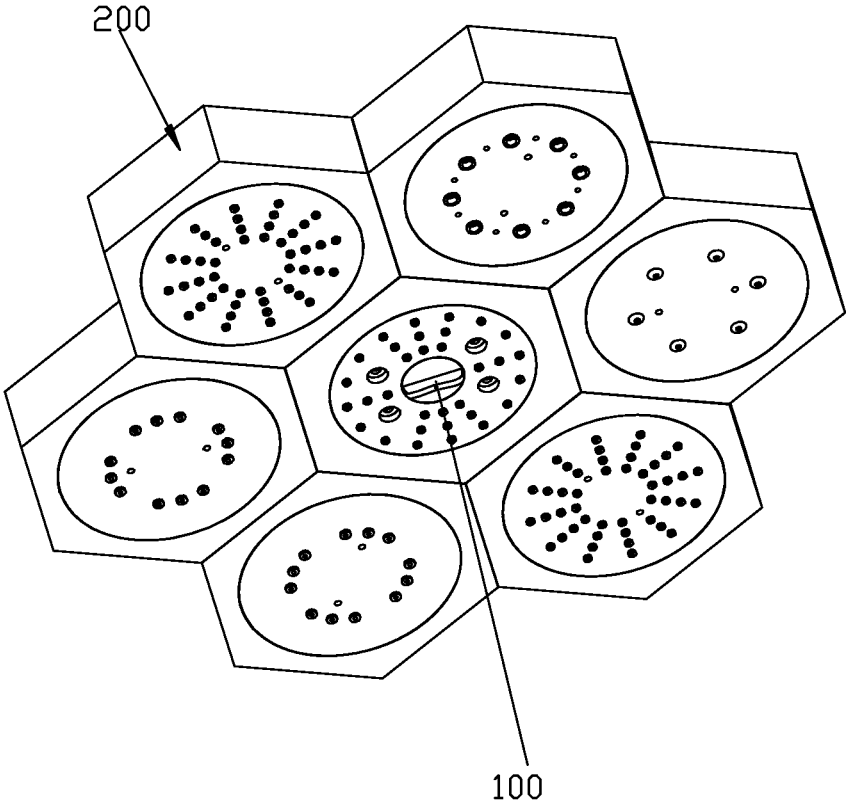
FIG. 8 illustrates the structure of the splicing shower of the second preferred embodiment of the present invention.
Figure 9:
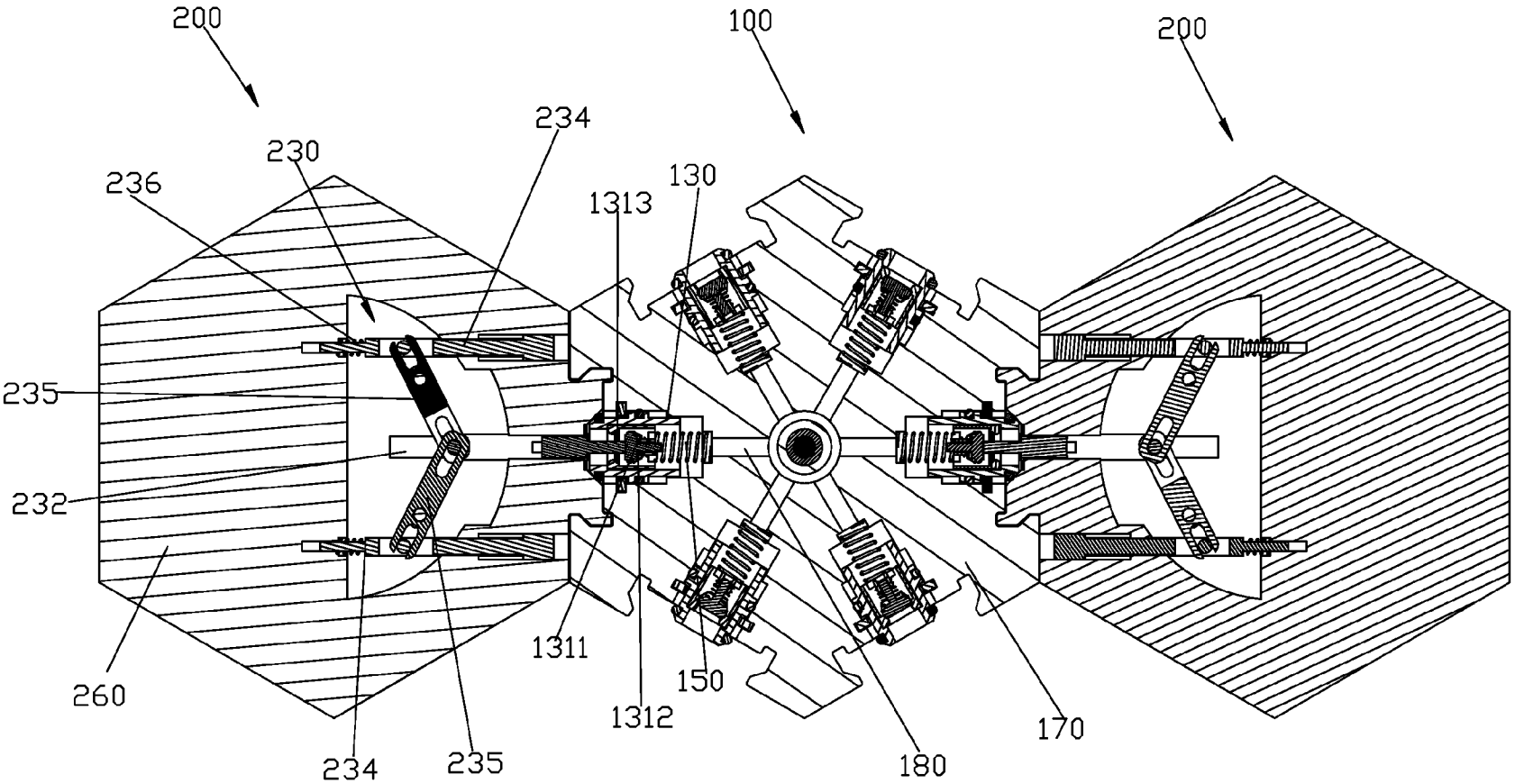
FIG. 9 illustrates the sectional view of the splicing shower of the second preferred embodiment of the present invention when the main shower is spliced with two assistant showers.
Figure 10:
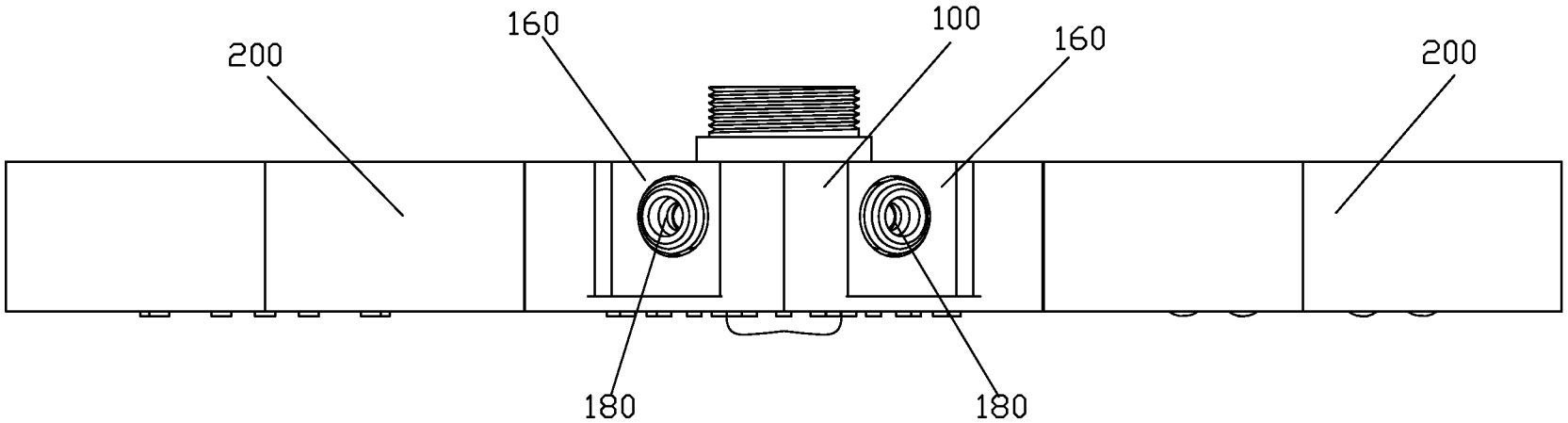
FIG. 10 illustrates the structure of the splicing shower of the second preferred embodiment of the present invention when the main shower is spliced with two assistant showers.
Figure 11:
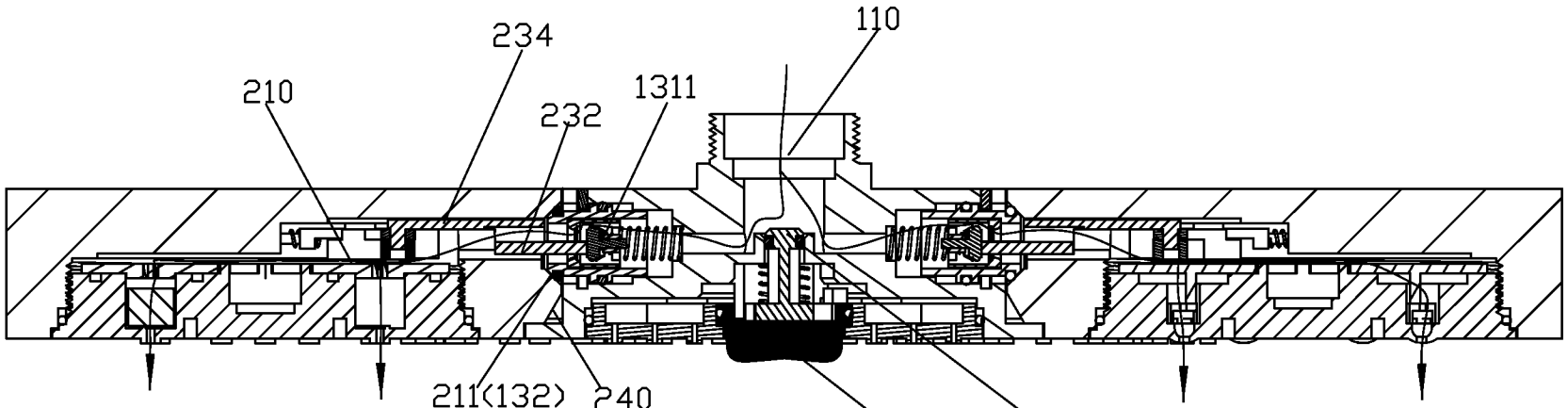
FIG. 11 illustrates the sectional view of the splicing shower of the second preferred embodiment of the present invention when the main shower is spliced with two assistant showers.
Figure 12:
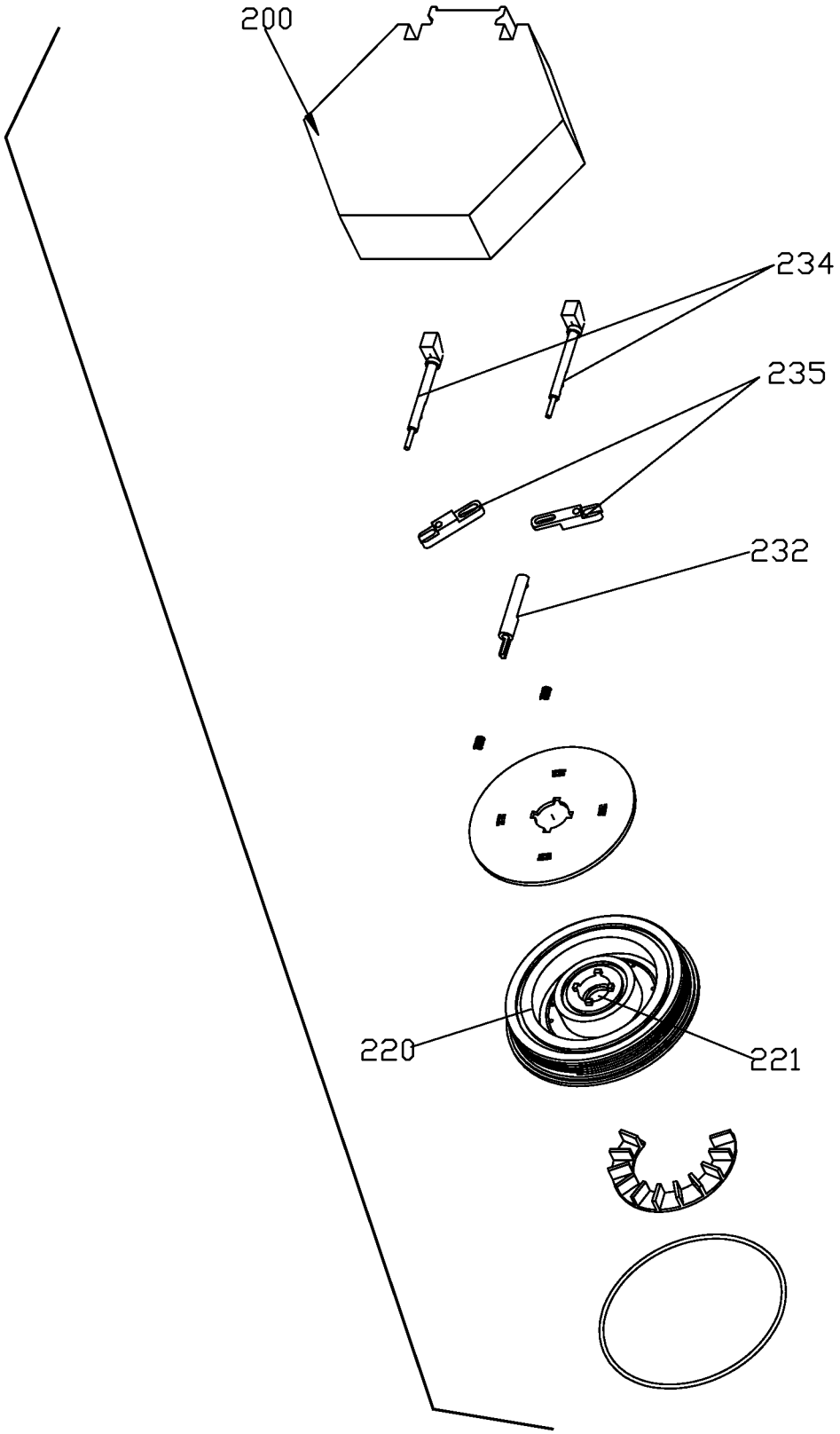
FIG. 12 illustrates the breakdown structure of the splicing shower of the second preferred embodiment of the present invention.

The second embodiment, the difference from above embodiment is that:

Refer to FIG. 8 to FIG. 12. The inside end of the assistant waterway 180 is connected to the central section of the inlet waterway 110, the outside end is a step groove of big outside small inside.

The assistant shower 200 is further disposed with a touch mechanism 230, which includes a push bar 232, a press bar 234, a linkage bar 235 and a restore spring 236. the press bar 234 is assembled inside the second body 260 of the assistant shower 200 in sliding way, the end of the press bar 234 is extended out of the guide inclined surface 240. the push bar 232 can be sliding into the diversion waterway 210 of the second body 260 of the assistant shower 200, and the push bar can be extended out of the outside end of the diversion waterway 210 of the assistant shower 200 to withstand the valve spool 1311. the centre of the linkage bar 235 is pivot joint to the second body 260 of the assistant shower 200, two ends of the linkage bar 235 are separately connected to the press bar 234 and the push bar 232, making that the press bar 234 slides to drive the push bar 232 to slide. To make sure the stability of the sliding of the push bar 232, it has better to disposed two press bars, two linkage bars and two connection grooves.

In this embodiment, to make sure the convenience of the assembly and disassembly of the water diversion connection and the diversion waterway 210, it can be designed that: the external wall of the outside end of the water diversion connection 130 is a first conical surface 132 of big inside small outside; the inner wall of the outside end of the diversion waterway is a second conical surface 211 of big outside small inside, the second conical surface 211 is coupled to the first conical surface 132; the part of the outside end face of the assistant shower 200 below the outside end of the diversion waterway 210 is a guide inclined surface 240.

Thereinto, when the assistant shower 200 is assembled to the main shower 100, the press bar 234 is sliding back, the linkage bar 235 is rotated, the push bar 232 is sliding out, the restore spring 236 is compressed to restore energy; when the assistant shower 200 is disassembled from the main shower 100, the restore spring 236 releases energy, making the press bar 234 sliding out, the linkage bar 235 rotated and the push bar (232) sliding back, the check valve is repositioned and closed.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

INDUSTRIAL APPLICABILITY

The present invention is provided with a splicing shower, in which the main shower and the assistant shower form an assembly and disassembly connection. the main shower is spliced with the assistant shower, the water diversion connection is connected to the diversion waterway, when the main shower is separated from the assistant shower, the on-off switch is turned off. User can change the outlet area by splicing of the main shower and the assistant shower as required.

What is claimed is:

1. A splicing shower, comprising:
a main shower, which is disposed with
an inlet waterway,
a main outlet assembly and
at least a water diversion connection,
the main outlet assembly is connected to the inlet waterway,
the water diversion connection is connected to the inlet waterway,
the water diversion connection is disposed with an on-off switch; and
at least an assistant shower, which is disposed with a diversion waterway and an assistant outlet assembly, the assistant outlet assembly is connected to the diversion waterway;
wherein the assistant shower can be spliced to the main shower to form an assembly and disassembly connection,
when the assistant shower is spliced to the main shower, the water diversion connection is connected to the diversion waterway,
when the assistant shower is separated from the main shower, the switch is turned off.

2. A splicing shower according to claim 1, wherein
the switch is a check valve, which is disposed with a valve spool and a withstand spring,
the valve spool is assembly inside the water diversion connection in sliding way,
the withstand spring is assembled inside the water diversion connection and withstood the valve spool to make the valve spool normal off.

3. A splicing shower according to claim 2, wherein
the assistant shower is further disposed with a touch mechanism, which includes a control member and a push bar,
the control member is controlled by user to drive the push bar to move, making the switch switched on/off.

4. A splicing shower according to claim 1, wherein the main shower is disposed with an on-off mechanism, which is controlled by user to control the on-off of the main outlet assembly and the inlet waterway.

5. A splicing shower according to claim 3, wherein
the control member is rotated and assembled in the assistant shower,
the push bar is assembled in the assistant shower in sliding way,
the push bar is extended out of the assistant shower to withstand the valve spool.

6. A splicing shower according to claim 5, wherein
the touch mechanism further includes a turnplate, which is rotated and assembled inside the assistant shower,
the turnplate is synchronously rotated with the control member coaxially, the shaft end face of the turnplate is disposed with a linkage groove,
the push bar is disposed with a linkage pin in the lower;
the linkage pin is connected to the linkage groove, making the turnplate driving the push bar to slide when the turnplate rotates.

7. A splicing shower according to claim 2, wherein
the assistant shower is further disposed with a touch mechanism, which includes a push bar connected to the assistant shower in sliding way,
when the assistant shower is assembled to the main shower, the touch mechanism makes the push bar sliding out to turn on the on-off switch,
when the assistant shower is disassembled from the main shower, the touch mechanism makes the push bar sliding back to turn off the on-off switch.

8. A splicing shower according to claim 7, wherein
the touch mechanism further includes a press bar, a linkage bar and a restore spring;
the press bar is assembled inside the assistant shower in sliding way;
the restore spring withstands the press bar and the assistant shower;
the centre of the linkage bar is pivot joint to the assistant shower, two ends of the linkage bar are separately connected to the press bar and the push bar, making that:
when the assistant shower is assembled to the main shower, the press bar is sliding back, the linkage bar is rotated, the push bar is sliding out, the restore spring is compressed to restore energy;
when the assistant shower is disassembled from the main shower, the restore spring releases energy, making the press bar sliding out, the linkage bar rotated and the push bar sliding back.

9. A splicing shower according to claim 8, wherein
the water diversion connection is assembled in the main shower in sidling way, a restore spring is disposed between the water diversion connection and the main shower;
the external wall of the outside end of the water diversion connection is a first conical surface of big inside small outside;
the inner wall of the outside end of the diversion waterway is a second conical surface of big outside small inside, the second conical surface is coupled to the first conical surface;
The part of the outside end face of the assistant shower below the outside end of the diversion waterway is a guide inclined surface;
The end of the press bar is extended out of the guide inclined surface.

10. A splicing shower according to claim 1, wherein
the side end face of the main shower is disposed with a lock groove, the water diversion connection is corresponding to the lock groove;

the end face of the assistant shower is disposed with a lock holder, the outside end of the diversion waterway is corresponding to the lock holder;

the lock holder can be spliced to the lock groove to form an assembly and disassembly connection.

11. A splicing shower according to claim 1, wherein the main shower is a regular hexagon shaped with six end faces, each end face is disposed with a lock groove, the water diversion connection is corresponding to the lock groove;

the number of the assistant shower is six, one end face of each assistant shower is disposed with a lock holder, the outside end of the diversion waterway is corresponding to the lock holder;

the lock holder can be spliced to the lock groove to form an assembly and disassembly connection.

12. A splicing shower according to claim 2, wherein the side end face of the main shower is disposed with a lock groove, the water diversion connection is corresponding to the lock groove;

the end face of the assistant shower is disposed with a lock holder, the outside end of the diversion waterway is corresponding to the lock holder;

the lock holder can be spliced to the lock groove to form an assembly and disassembly connection.

13. A splicing shower according to claim 3, wherein the side end face of the main shower is disposed with a lock groove, the water diversion connection is corresponding to the lock groove;

the end face of the assistant shower is disposed with a lock holder, the outside end of the diversion waterway is corresponding to the lock holder;

the lock holder can be spliced to the lock groove to form an assembly and disassembly connection.

14. A splicing shower according to claim 4, wherein the side end face of the main shower is disposed with a lock groove, the water diversion connection is corresponding to the lock groove;

the end face of the assistant shower is disposed with a lock holder, the outside end of the diversion waterway is corresponding to the lock holder;

the lock holder can be spliced to the lock groove to form an assembly and disassembly connection.

15. A splicing shower according to claim 5, wherein the side end face of the main shower is disposed with a lock groove, the water diversion connection is corresponding to the lock groove;

the end face of the assistant shower is disposed with a lock holder, the outside end of the diversion waterway is corresponding to the lock holder;

the lock holder can be spliced to the lock groove to form an assembly and disassembly connection.

16. A splicing shower according to claim 6, wherein the side end face of the main shower is disposed with a lock groove, the water diversion connection is corresponding to the lock groove;

the end face of the assistant shower is disposed with a lock holder, the outside end of the diversion waterway is corresponding to the lock holder;

the lock holder can be spliced to the lock groove to form an assembly and disassembly connection.

17. A splicing shower according to claim 7, wherein the side end face of the main shower is disposed with a lock groove, the water diversion connection is corresponding to the lock groove;

the end face of the assistant shower is disposed with a lock holder, the outside end of the diversion waterway is corresponding to the lock holder;

the lock holder can be spliced to the lock groove to form an assembly and disassembly connection.

18. A splicing shower according to 8, wherein the side end face of the main shower is disposed with a lock groove, the water diversion connection is corresponding to the lock groove;

the end face of the assistant shower is disposed with a lock holder, the outside end of the diversion waterway is corresponding to the lock holder;

the lock holder can be spliced to the lock groove to form an assembly and disassembly connection.

19. A splicing shower according to claim 9, wherein the side end face of the main shower is disposed with a lock groove, the water diversion connection is corresponding to the lock groove;

the end face of the assistant shower is disposed with a lock holder, the outside end of the diversion waterway is corresponding to the lock holder;

the lock holder can be spliced to the lock groove to form an assembly and disassembly connection.

* * * * *